US009932164B1

(12) United States Patent
Vogeler

(10) Patent No.: US 9,932,164 B1
(45) Date of Patent: Apr. 3, 2018

(54) SPONGE FOR INSERTION INTO A MUD PAN

(71) Applicant: Craig A. Vogeler, North Loup, NE (US)

(72) Inventor: Craig A. Vogeler, North Loup, NE (US)

( * ) Notice: Subject to any disclaimer, the term of this patent is extended or adjusted under 35 U.S.C. 154(b) by 0 days.

(21) Appl. No.: 14/680,586

(22) Filed: Apr. 7, 2015

(51) Int. Cl.
*B65D 81/22* (2006.01)
*B65D 51/24* (2006.01)
*B65D 1/34* (2006.01)

(52) U.S. Cl.
CPC ..... *B65D 81/22* (2013.01); *B65D 1/34* (2013.01); *B65D 51/24* (2013.01)

(58) Field of Classification Search
CPC ..... B65D 81/22; B65D 51/24; B44C 7/02
See application file for complete search history.

(56) References Cited

U.S. PATENT DOCUMENTS 4,638,909 A * 1/1987 Ford ..... B44D 3/04 206/1.7
5,048,710 A * 9/1991 Diston ..... B44C 7/02 150/154
5,603,428 A 2/1997 Breckwoldt
6,575,328 B1 6/2003 Foraker
2011/0290803 A1 12/2011 Kehres

* cited by examiner

*Primary Examiner* — Jeffrey Allen
*Assistant Examiner* — Jennifer Castriotta
(74) *Attorney, Agent, or Firm* — Dennis L. Thomte; Thomte Patent Law Office LLC

(57) ABSTRACT

A sponge for insertion into the open upper end of a mud pan which acts as a plug to prevent the mud in the mud pan from drying out during periods of non-use of the mud pan.

1 Claim, 4 Drawing Sheets

SPONGE FOR INSERTION INTO A MUD PAN

BACKGROUND OF THE INVENTION

Field of the Invention

This invention relates to a sponge which may be inserted into a mud pan during periods of non-use of the mud pan to prevent the mud or joint compound in the mud pan from drying out.

Description of the Related Art

Joint compound containers, known in the trade as "mud pans", have long been used by dry wall installers when joining hung wallboard. The most commonly used mud pans have a flat bottom, two sloping side walls extending upwardly and outwardly from bottom and two sloping end walls extending upwardly and outwardly from the bottom.

The mud pans are filled with a joint compound or mud which the installer or drywaller utilizes in finishing the wall boards. Frequently, when the installer is taking a break or will not be using the mud pan for some time, the drywaller must clean the mud pan to prevent the mud therein from drying and caking therein. The cleaning of the mud pan is time consuming and results in the wastage of any mud left in the mud pan prior to the cleaning of the mud pan.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A sponge is described for use with a mud pan having a bottom, with a first side edge, a second side edge, a first end edge, a second end edge, a first side wall, having upper and lower ends, which extends upwardly and outwardly from the first side edge of the bottom, a second side wall, having upper and lower ends, which extends upwardly and outwardly from the second side edge of the bottom, a first end wall, having upper and lower ends, which extends upwardly and outwardly from the first end edge of the bottom, and a second end wall, having upper and lower ends, which extends upwardly and outwardly from the second end edge of the bottom. The sponge is configured to be selectively removably inserted into the mud pan to prevent the mud in the mud pan from drying out when the mud pan is not being used.

In the preferred embodiment, the sponge is comprised of a cellulose material. In the preferred embodiment, the sponge includes a top wall having a first side edge, a second side edge, a first end edge, a second end edge, a first side wall, having upper and lower ends, extending downwardly and inwardly from the first side edge of the top wall of the sponge, a second side wall, having upper and lower ends, extending downwardly and inwardly from the second side edge of the top wall of the sponge. The sponge also includes a first end wall, having upper and lower ends, which extends downwardly and inwardly from the first end edge of the sponge. The sponge also includes a second end wall, having upper and lower ends, which extends downwardly and inwardly from the second end edge of the sponge. The sponge also has a bottom wall extending between the lower ends of the first side wall, the second side wall, the first end wall, and the second end wall of the sponge.

In the preferred embodiment, each of the upper ends of the walls of the sponge have a lip which extends outwardly therefrom with the lips engaging the upper ends of the walls of the mud pan. When the mud pan is not being used for some time, the sponge is inserted downwardly into the interior of the mud pan to prevent the mud in the mud pan from drying out.

It is therefore a principal object of the invention to provide a sponge for use with a mud pan to prevent the mud in the mud pan from drying out during periods of non-use.

A further object of the invention is to provide a sponge of the type described which acts as a plug thereby keeping the pan contents moist.

A further object of the invention is to provide a sponge for a mud pan which eliminates the need to clean the mud pan when not in use.

A further object of the invention is to provide a sponge of the type described which may be used for cleaning tools.

A further object of the invention is to provide a sponge of the type described which may be used for texturing.

A further object of the invention is to provide a sponge of the type described which may be used for the cleaning of spills.

A further object of the invention is to provide a sponge of the type described which is economical of manufacture and durable in use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
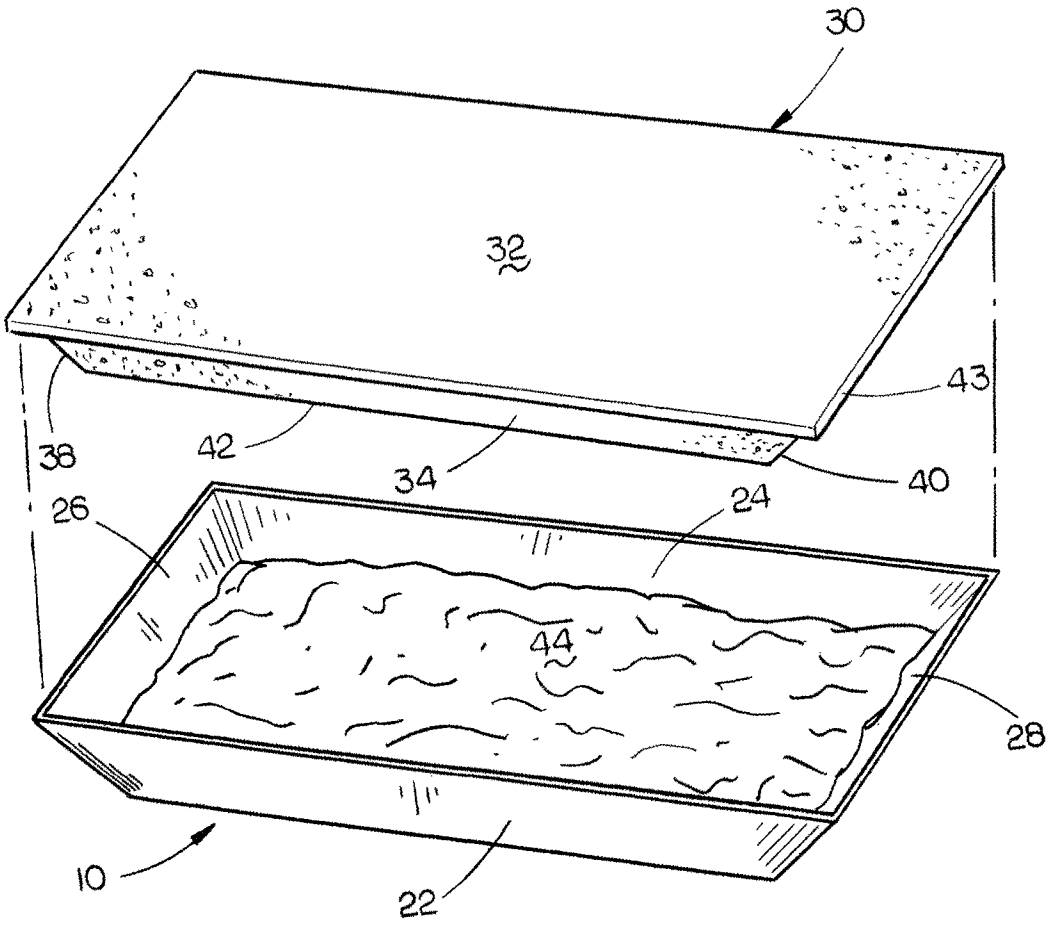
FIG. 1 is an exploded perspective view of the sponge of this invention and its relationship to a mud pan.
Figure 2:
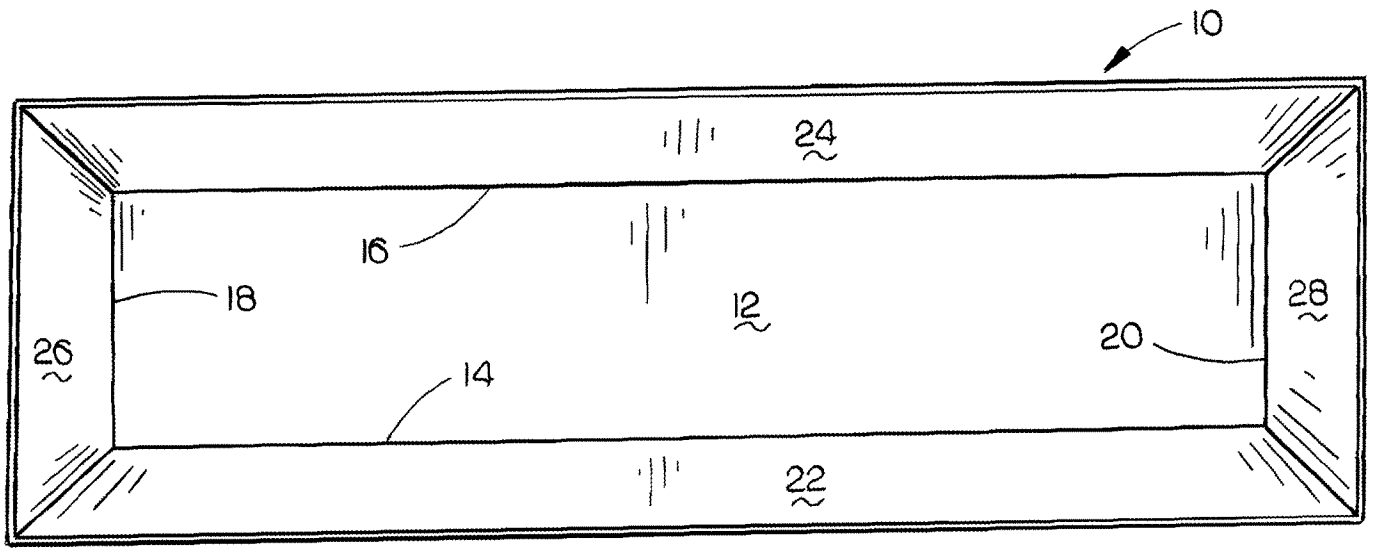
FIG. 2 is a top view of the mud pan of FIG. 1.
Figure 3:
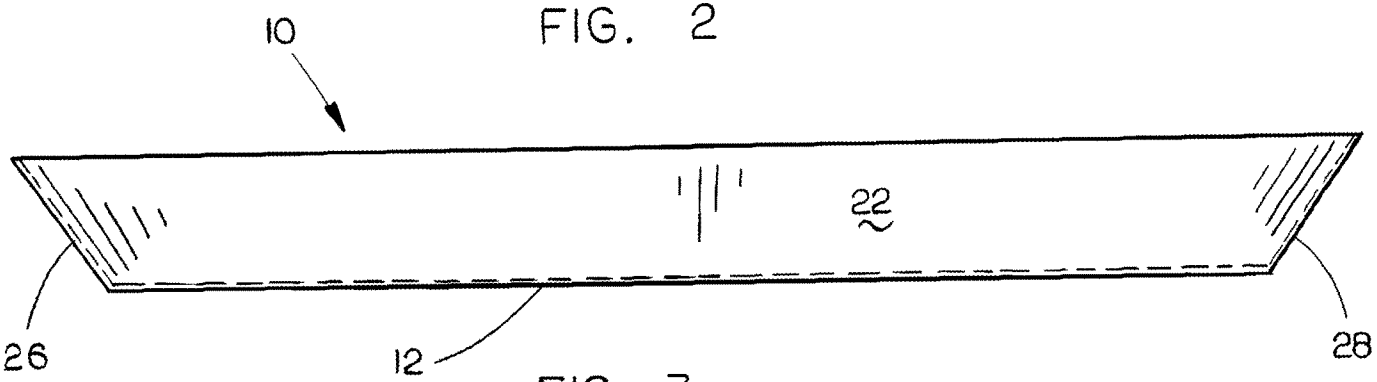
FIG. 3 is a side elevational view of the mud pan of FIGS. 1 and 2.
Figure 4:
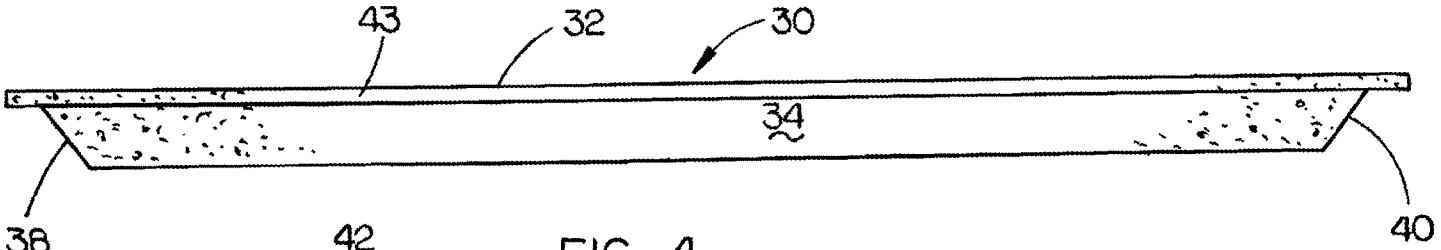
FIG. 4 is a side view of the sponge of this invention.
Figure 5:
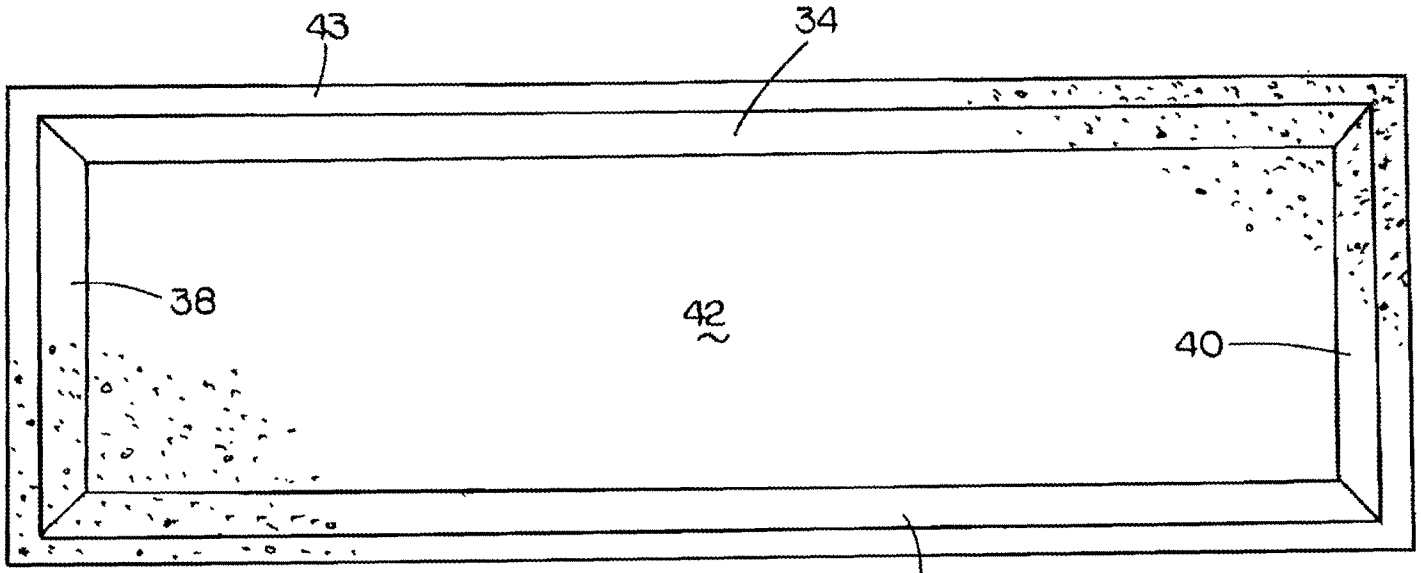
FIG. 5 is a bottom view of the sponge of this invention.
Figure 6:
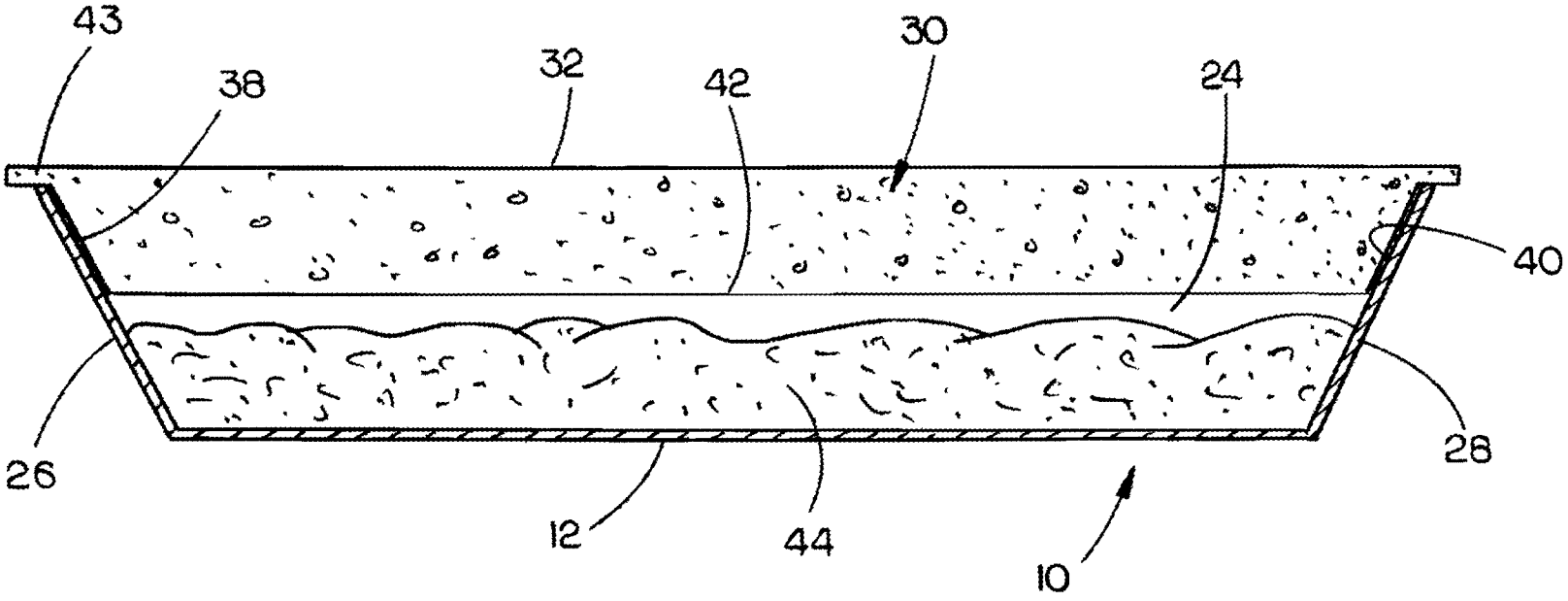
FIG. 6 is a sectional view illustrating the sponge of this invention inserted into the mud pan.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a conventional mud pan which may be constructed of metal or plastic. Mud pan 10 includes a bottom 12 having a first side edge 14, a second side edge 16, a first end edge 18 and a second end edge 20. Mud pan 10 also includes a first side wall 22 which extends upwardly and outwardly from first side edge 14 of bottom 12. Mud pan 10 further includes a second side wall 24 which extends upwardly and outwardly from the second side edge 16 of bottom 12. Mud pan 10 also includes a first end wall 26 which extends upwardly and outwardly from first end edge 18 of bottom 12. Mud pan 10 further includes a second end wall 28 which extends upwardly and outwardly from the second end edge 20.

The numeral 30 refers to a sponge comprised of a cellulose material or other open cell material. Sponge 30 includes a top wall 32, a first side wall 34, a second side wall 36, a first end wall 38, a second end wall 40 and a bottom 42. The walls of the sponge dwell in the same angles as the wall of the mud pan. The upper ends of the walls 32, 34, 36, 38, and 40 have a lip 43 which extends horizontally outwardly therefrom.

The sponge 30 is not utilized until the drywaller or plasterer takes a break when the mud pan is not going to be used for a period of time. Rather than the drywaller or plasterer cleaning the mud pan, the drywaller or plasterer will insert the sponge 30 into the interior of the mud pan 10. The sponge 30 is inserted into the interior of the mud pan 10 until the lip 43 of the sponge 30 rests on the upper ends of the walls 22, 24, 26 and 28 which limits the downward insertion of the sponge 30 with respect to the mud pan. Normally, the sponge 30 has a thickness of one inch while the depth of the mud pan 10 may be three inches, more or less. Thus, the bottom 42 of sponge is positioned above the bottom 12 of the mud pan 10. When the sponge 30 is positioned within the mud pan 10, the sponge 30 acts as a plug to prevent the mud 44 in the mud pan 10 from drying out. In some cases, the sponge 30 may be soaked with water prior to being placed into the mud pan 10. When the drywaller or plasterer resumes the drywall taping or plastering, the sponge 30 is removed from the mud pan 30.

The sponge 30 also has additional uses. It may be used to texture drywalls or plaster. It may also be used to clean tools or to clean up spills.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination with a mud pan having a bottom wall with a first side edge, a second side edge, a first end edge, a second end edge, a first side wall, having upper and lower ends, which extends upwardly and outwardly from the first side edge of the bottom wall, a second side wall, having upper and lower ends, which extends upwardly and outwardly from the second side edge of the bottom wall, a first end wall, having upper and lower ends, extending upwardly and outwardly from the first end edge of the bottom wall, and a second end wall, having upper and lower ends, extending upwardly and outwardly from the second end edge of the bottom wall, comprising:

a sponge configured to be selectively and removably inserted into the mud pan to prevent mud in the mud pan from drying out;

said sponge including:

(a) a horizontally disposed top wall having a first side edge, a second side edge, a first end, and a second end;

(b) an inclined first side wall, having upper and lower ends, extending downwardly and inwardly from said top wall inwardly of said first side edge of said top wall to create a lip which extends horizontally outwardly from said upper end of said inclined first side wall of said sponge;

(c) an inclined second side wall, having upper and lower ends, extending downwardly and inwardly from said top wall inwardly of said second side edge of said top wall to create a lip which extends horizontally outwardly from said upper end of said inclined second side wall of said sponge;

(d) an inclined first end wall, having upper and lower ends, extending downwardly and inwardly from said top wall inwardly of said first end of said top wall to create a lip which extends horizontally outwardly from said upper end of said inclined first end wall of said sponge;

(e) an inclined second end wall, having upper and lower ends, extending downwardly and inwardly from said top wall inwardly of said second end of said top wall to create a lip which extends horizontally outwardly from said upper end of said inclined second end wall of said sponge;

(f) a horizontally disposed bottom wall extending between said lower ends of said first side wall, said second side wall, said first end wall and said second end wall of said sponge;

said inclined first side wall, said inclined second side wall, said inclined first end wall and said inclined second end wall of said sponge being in engagement with the inclined first side wall, the inclined second side wall, the inclined first end wall and the inclined second end wall respectively of the mud pan when said sponge is inserted into the mud pan;

said lips of said sponge being positioned on the upper ends of the first side wall, the second side wall, the first end wall and the second end wall of the mud pan when said sponge is inserted into the mud pan;

said lower ends of said inclined first side wall, said inclined second side wall, said inclined first end wall and said inclined second end wall being spaced-above the bottom wall of the mud pan when said sponge is inserted into the mud pan.

* * * * *